US006131757A

United States Patent [19]

Clark et al.

[11] Patent Number: 6,131,757

[45] **Date of Patent: *Oct. 17, 2000**

[54] COLLAPSIBLE BOX

[76] Inventors: Robert A. Clark, 15311 Quail Run Dr., Darnestown, Md. 20878; John Parnall, 18 Windward Dr., Severna Park, Md. 21146

[ * ] Notice: This patent issued on a continued prosecution application filed under 37 CFR 1.53(d), and is subject to the twenty year patent term provisions of 35 U.S.C. 154(a)(2).

[21] Appl. No.: 08/257,449

[22] Filed: Jun. 7, 1994

Related U.S. Application Data

[63] Continuation of application No. 08/107,119, Aug. 17, 1993, abandoned.

[51] Int. Cl.[7] ..... B65D 6/12

[52] U.S. Cl. ..... 220/7; 220/6; 220/4.28

[58] Field of Search ..... 220/4.28, 6, 7, 220/4.16, 4.17, 4.33, 4.34, 666, 672, 675, 686, 687; 217/15, 47

[56] References Cited

U.S. PATENT DOCUMENTS

| | | | |
|---|---|---|---|
| 564,914 | 7/1896 | Chamberlain | 217/15 |
| 1,043,474 | 11/1912 | Smith | 217/15 |
| 1,082,274 | 12/1913 | Lapish | 217/15 |
| 1,378,614 | 5/1921 | McLeod | 217/15 |
| 1,471,508 | 10/1923 | Spangler | 217/15 |
| 3,497,127 | 2/1970 | Box | 220/7 |
| 3,675,808 | 7/1972 | Brink | 220/7 |
| 4,057,165 | 11/1977 | Kardell | 220/6 |
| 4,062,467 | 12/1977 | Friedrich | 220/7 |

*Primary Examiner*—Stephen K. Cronin

*Attorney, Agent, or Firm*—H. Jay Spiegel

[57] ABSTRACT

A collapsible box has hinges which are vertically staggered to permit the box to collapse into a relatively flat configuration for easy stacking and transport. When the box is erected, interlocking features on the edges of the sides of thus box interengage to hold the box in a vertical configuration. A peripheral groove is provided to receive a shipping strap. The walls of the box are hinged to the bottom of the box in such a way that the walls may pivot inwardly to collapse the box as well as outwardly to permit easy cleaning of the inner surfaces of the box walls.

11 Claims, 6 Drawing Sheets

COLLAPSIBLE BOX

This application is a continuation of application Ser. No. 08/107,119 filed Aug. 17, 1993 now abandoned.

BACKGROUND OF THE INVENTION

The present invention relates to an improved collapsible box. In the prior art, fruits and vegetables are commonly shipped from their point of origin in corrugated containers which are discarded after a single use. Such discarding of corrugated containers wastes materials, such as wood products used for corrugated containers, wastes space in landfills and wastes money.

Alternatively, fruits and vegetables are shipped from their point of origin in boxes which are reusable but which are not collapsible. When such containers are employed, returning of the containers to their point of origin is expensive because, since they do not collapse, they take up a lot of room on a ship.

With environmental concerns growing year by year, a need has developed for a container designed to be effectively employed in shipping fruits and vegetables, which container may be erected, stacked in several rows for transport, and which may be collapsed to a volume of no more than one-fifth its erected volume so that such a container may be economically returned to its point of origin for re-use.

The following prior art is known to Applicants:

U.S. Pat. No. 1,132,812 to Webster discloses a collapsible metal packing case including sheet metal walls with reinforcing straps, with the packing case being collapsible to a flat configuration. The present invention differs from the teachings of Webster as contemplating sequential collapsing of the walls of a container, and wherein the walls have openings therethrough to provide ventilation for fruits and vegetables carried within the container.

U.S. Pat. No. 1,404,632 to Morgan discloses a corn drier consisting of a container having ventilated walls and wherein three of the walls are hinged together whereas a fourth wall is solely hinged to a bottom wall. The fourth wall may pivot outwardly away from the bottom wall, however, due to the configuration of the bottom wall, the fourth wall may not pivot inwardly. The present invention differs from the teachings of Morgan as contemplating a collapsible container wherein the four walls thereof may collapse inwardly as well as outwardly and wherein each wall is separately collapsed when the entire container is collapsed.

U.S. Pat. No. 2,375,374 to Lepp discloses a hold-down clip for carton closure flaps designed to interengage between two adjacent container walls. This patent is believed to be of only general interest concerning the teachings of the present invention.

U.S. Pat. No. 3,481,311 to Schluttig discloses a collapsible pet carrier including a plurality of walls which may be collapsed for easy transport of the device. Schluttig requires a complicated guidance mechanism to guide the collapsing of the carrier. The present invention differs from the teachings of Schluttig as contemplating four walls each of which is pivotably connected to a bottom wall, which walls may simply collapse into a flat configuration without the need for any guidance structure.

U.S. Pat. No. 4,083,464 to Burnett discloses a knockdown reusable container including clips designed to hold the various sides in assembled configuration. The present invention differs from the teachings of Burnett as contemplating a collapsible container having a bottom and four sides pivotably mounted on the bottom, which container may be collapsed into a flat configuration.

U.S. Pat. No. 4,181,236 to Prodel discloses a collapsible and stackable plastic transport case including a bottom, side walls and a cover. The Prodel device is designed to be collapsible into a small configuration for easy transport when not in use as a container. The present invention differs from the teachings of Prodel as contemplating a collapsible shipping crate wherein the side walls thereof are ventilated to provide ventilation to fresh produce contained therein and wherein the hinges are vertically staggered to allow easy collapsing into a flat configuration for return to point of origin and re-use.

U.S. Pat. No. 4,674,647 to Gyenge et al. discloses a collapsible storage bin including a plurality of walls which may be pivoted to an upright position to form a container and wherein hinges are vertically staggered to permit collapsing into a generally flat configuration. In Gyenge et al., the hinges of the end walls are vertically staggered since the height of the end walls causes them to be in an overlapping configuration when collapsed. In the present invention, by contrast, since the end walls are short enough in height so that they will not overlap in the collapsed configuration, their hinges are at equal vertical height. Furthermore, in Gyenge et al., the hinge structures are specifically designed to prevent the end walls from pivoting past vertical. In other words, the end walls may only collapse inwardly. In contrast to this, in the present invention, the walls thereof may pivot outwardly as well as inwardly, with the outward pivoting being provided to facilitate cleaning.

SUMMARY OF THE INVENTION

The present invention relates to an improved collapsible box. The inventive box is re-useable and recycleable. The present invention includes the following interrelated objects, aspects and features:

(A) In a first aspect of the present invention, a collapsible box consists of a bottom wall or base, as well as pairs of side and end walls hingedly mounted to the bottom wall. (B) Each of the side walls and end walls is mounted to the bottom wall with a hinge which permits pivoting inwardly to a collapsed configuration, vertically to an erected configuration and outwardly to a position permitting easy cleaning of the inner surfaces of the respective walls.

(C) One of the side walls is hinged to the bottom wall at a vertical displacement closely adjacent the bottom wall, whereas the other side wall has its hinge slightly vertically displaced above the elevation of the hinge for the first-mentioned side wall. This configuration is provided because when the box is collapsed, an overlap exists between the side walls and the vertical spacing between the respective elevations of the hinges for the first-mentioned and second-mentioned side walls permits sequential folding of the first-mentioned and second-mentioned side walls in staggered, yet relatively flat configuration.

(D) The respective hinges hingedly mounting the end walls to the bottom wall are at equal elevation with respect to one another. This is because when the end walls are moved to the collapsed configuration, they do not overlap with one another, but rather merely overlie the second-mentioned side wall.

(E) The top edges of the side and end walls carry a plurality of upwardly extending projections which enmesh with recesses formed about the periphery of the bottom wall so that interengagement of these respective projections and recesses permits vertical stacking of erected boxes while precluding lateral shifting of stacks thereof.

(F) In a further aspect, faces of the end walls include vertically elongated projections which correspond with vertically elongated recesses formed in the sides of the side walls. These projections and recesses enmesh when the container is erected to preclude inward collapsing of the container. Additionally, the projections and recesses may interengage with a frictional interconnection which also deters outward pivoting of the various walls. The outside face of the second-mentioned side wall may carry a groove adjacent the hinge thereof which corresponds in shape and configuration to the grooves in the sides of the side walls. This groove in the outside face of the second-mentioned side wall may receive one of the projections from the end wall so as to lock the container in the collapsed configuration. An additional embodiment utilizing projections and recesses to deter outward pivoting of the various walls of the inventive container is also disclosed.

(G) In the preferred embodiment of the present invention, the side walls and end walls have a lattice-like configuration having a multiplicity of openings therethrough to provide ventilation to the contents of the container when erected. The side walls may include areas to receive labels and bar codes and may also include one or more openings designed to be usable as a handle. If desired, the inventive container may be made of a suitable injection molded plastic. If desired, an insect repelling chemical may be impregnated into the various box components during manufacture so that insects are continuously repelled as the insect repellant emits fumes from the box structure.

(H) In a further aspect, grooves may be formed in the side and end walls which, when the box is erected, form a continuous or, at least, series of aligned recesses about the periphery of the box. This groove or series of spaced aligned grooves provides means for receiving an elongated strap which may be fastened about the periphery of the box while being maintained within the groove or spaced grooves to absolutely preclude the box from collapsing outwardly.

As such, it is a first object of the present invention to provide an improved collapsible box.

It is a further object of the present invention to provide such an improved collapsible box with hinge structure allowing the side and end walls thereof to collapse both inwardly and outwardly.

It is a yet further object of the present invention to provide such an improved collapsible box with hinges which are vertically staggered to permit collapsing into a relatively flat configuration.

It is a still further object of the present invention to provide such a box wherein interlocking structures are provided to hold the box in an erected configuration.

It is a still further object of the present invention to provide such a box including the provision for receiving a peripheral fastening strap.

It is a still further object of the present invention to provide such a collapsible box with a lattice-like series of openings in the walls thereof.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
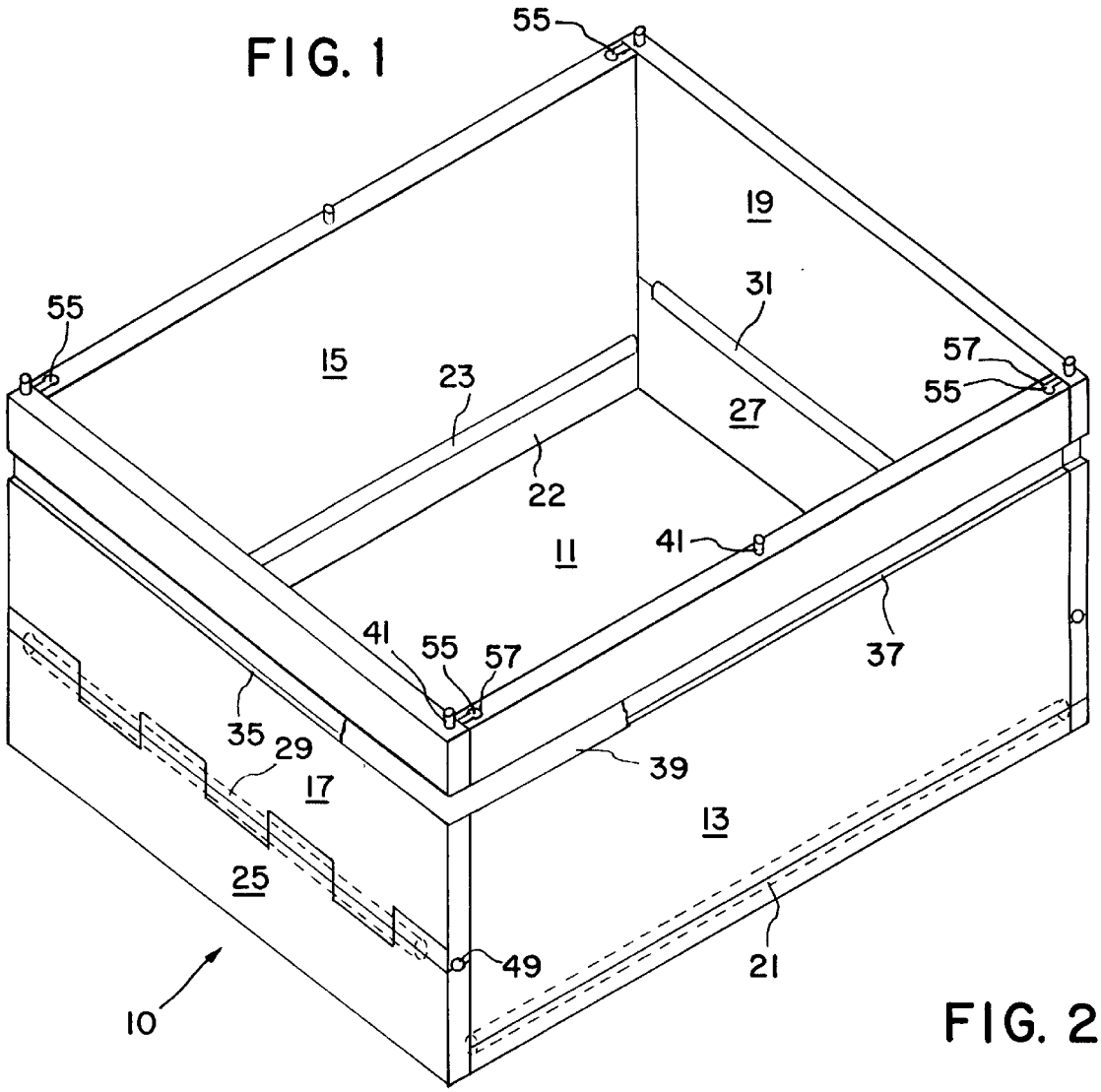
FIG. 1 shows a perspective view of a box made in accordance with the teachings of the present invention.

With reference, first, to FIG. 1, a box made in accordance with the teachings of the present invention is generally designated by the reference numeral 10 and is seen to include a bottom wall or base 11, side walls 13 and 15 and end walls 17 and 19. As shown in FIG. 1, the side walls 13 and 15 are hingedly mounted to the bottom wall 11 by virtue of respective hinges 21 and 23. As should be understood from FIG. 1, the hinge 23 is slightly elevated with respect to the hinge 21. This is because when the box 10 is collapsed, the side wall 13 is folded inwardly first and, thereafter, the side wall 15 is pivoted inwardly. The height of the walls 13 and 15 with respect to the configuration of the bottom wall 11 causes an overlap between the walls 13 and 15 when they are collapsed. Thus, the vertical staggering of the hinge 23 with respect to the hinge 21 allows the wall 15 to lie flat slightly overlapping the wall 13. As should be understood, the spacing between the centerlines of the hinges 21 and 23 is approximately equal to the thickness of one of the walls 13, 15.

As should also be understood from FIG. 1, the bottom wall 11 terminates at a pair of upstanding short walls 25 and 27 which respectively connect the end walls 17 and 19 to the bottom wall 11. The end wall 17 is hingedly connected to the short wall 25 via the hinge 29 while the end wall 19 is hingedly connected to the short wall 27 by virtue of the hinge 31. As should be understood from FIG. 1, the hinges 29 and 31 are at equal elevation with respect to one another and are slightly elevated with respect to the hinge 23 which hingedly mounts the side wall 15 to a short wall 22 interposed between the side wall 15 and the bottom wall 11. The hinges 29 and 31 are at equal elevation because the height of the end walls 17 and 19 when considered in conjunction with the dimensions of the bottom wall 11 causes the end walls 17 and 19 to be able to collapse without overlapping. This aspect is best seen with reference to FIG. 7. The centerlines of the hinges 29, 31 are elevated with respect to the centerline of the hinge 23 by a distance approximately equal to the thickness of the walls 17, 19.

As shown in FIG. 1, grooves 35, 37 are formed in the end wall 17 and the side wall 13, respectively. Corresponding grooves (not shown in FIG. 1) are also formed in the walls 15 and 19 to provide a continuous peripheral groove. As shown in FIG. 1, a strap 39 may be engaged about the grooves 35 and 37 as well as the corresponding grooves in the walls 19 and 15 to provide a peripheral securement about the walls of the box 10 when the walls are erected as shown in FIG. 1. If desired, the grooves 35, 37 and the corresponding grooves in the walls 19 and 15 may be continuous or, in fact, may be comprised of a multiplicity of spaced groove portions which are vertically aligned with one another to allow placement of the strap 39 in the manner shown in FIG. 1 so that the strap 39, when so assembled to the box 10, may not disengage from the grooves.

As further shown in FIG. 1, a series of projections 41 are provided at spaced locations around the top surfaces of the various walls of the box 10. Corresponding recesses 42 (FIG. 5) formed about the periphery of the bottom wall 11 permit stacking, vertically, of a plurality of boxes 10 while precluding lateral shifting of such stacks.

Figure 2:
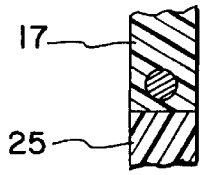
FIG. 2 shows a close-up view of typical hinge structure of the present invention.

FIG. 2 shows an enlarged view of the short wall 25 and the end wall 17, intended to show details of the hinge structure therebetween. Firstly, it must be noted that the hinge structure shown in FIG. 2 is typical of all of the hinge structures of the present invention. With particular reference to FIG. 2, it is seen that the end wall 17 has a bottom surface comprising a plurality of projections 43 laterally spaced from one another with the spacings allowing receipt of upwardly extending projecting portions 45 forming a part of the short wall 25. The portions 43 include passageways 47 therethrough which may align with passageways 49 formed in the projections 45. An elongated rod 51 shown in phantom in FIG. 2 and with the end thereof visible in FIG. 1 may be inserted through the aligned passageways 47, 49 to assemble the hinge structure between the end wall 17 and the short wall 25. Such a hinge is known as a "barrel hinge".

Figure 3:
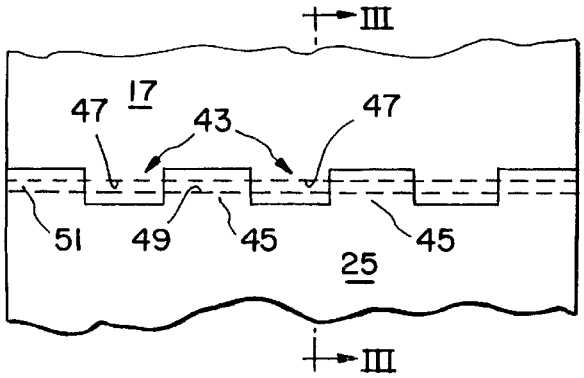
FIG. 3 shows a cross-sectional view along the line III—III of FIG. 2.

FIG. 3 shows a cross-sectional view along the line III—III of FIG. 2 and shows that the structure of the hinge permits pivoting in any direction both inwardly to a collapsed configuration and outwardly to a configuration permitting easy cleaning.

Figure 4:
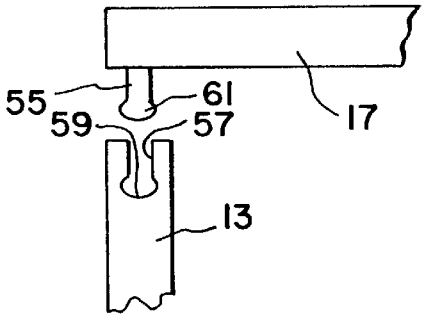
FIG. 4 shows a view looking downwardly at an intersecting corner between an end wall and a side wall of the present invention showing specific details of a projection and recess structure.

With reference to FIGS. 1 and 4, in particular, it is seen that the end walls 17 and 19 include, each, two inwardly extending elongated projections 55. The sides of the side walls 13 and 15 have corresponding recesses 57 designed to receive the projections 55. As particularly seen in FIG. 4, the recesses may include an enlarged end 59 designed to frictionally receive the enlarged end 61 of the projection 55 so that strong frictional retention of the end walls to the side walls may be accomplished. In the preferred embodiment, the projections 55 are elongated, extending virtually the entirety of the height of the respective end walls 17 and 19 either in a unitary fashion or in an interrupted pattern.

Figure 6:
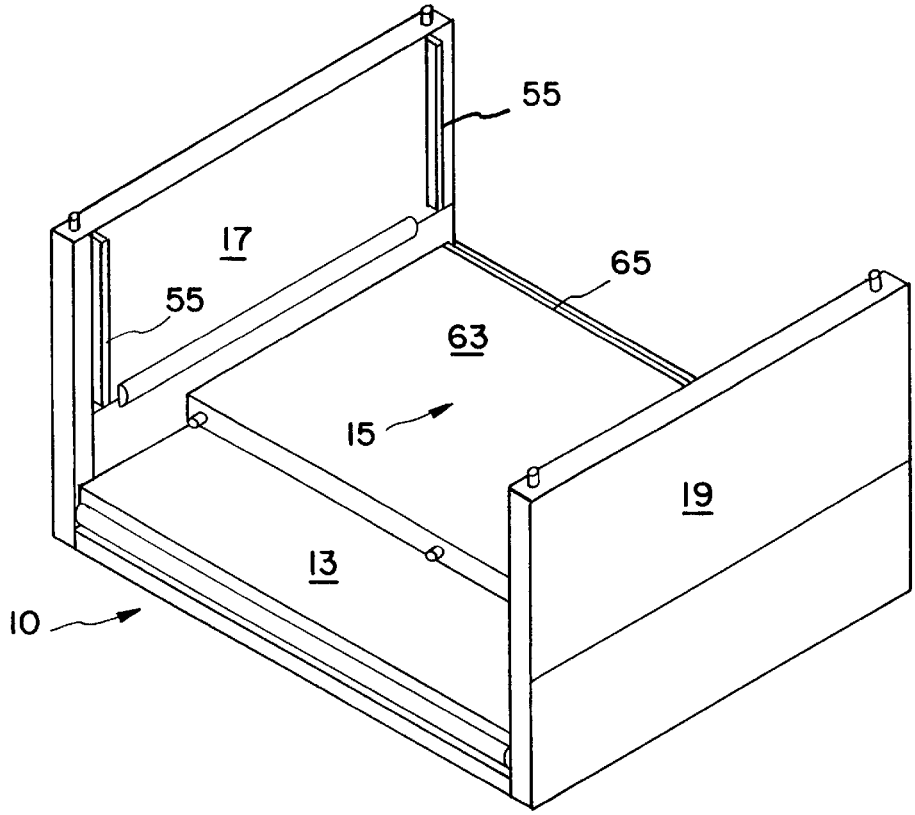
FIG. 6 shows a perspective view of the present invention with both of its side walls collapsed.

With reference to FIG. 6, it is seen that the outer face 63 of the side wall 15 has an elongated groove 65 corresponding in configuration to the grooves 57. As should be understood from FIG. 6, the groove 65 is aligned with one of the grooves 55 of the end wall 17 when the side wall 15 has been collapsed over the side wall 13 as shown in FIG. 6. In this way, when the end wall 17 is folded over the side wall 15, the projection 55 of the end wall 17 may enter the groove 65 to lock the container 10 in folded configuration. Similarly, one of the projections 55 of the end wall 19 may also enter the elongated groove 65 for the same purpose.

Figure 5:
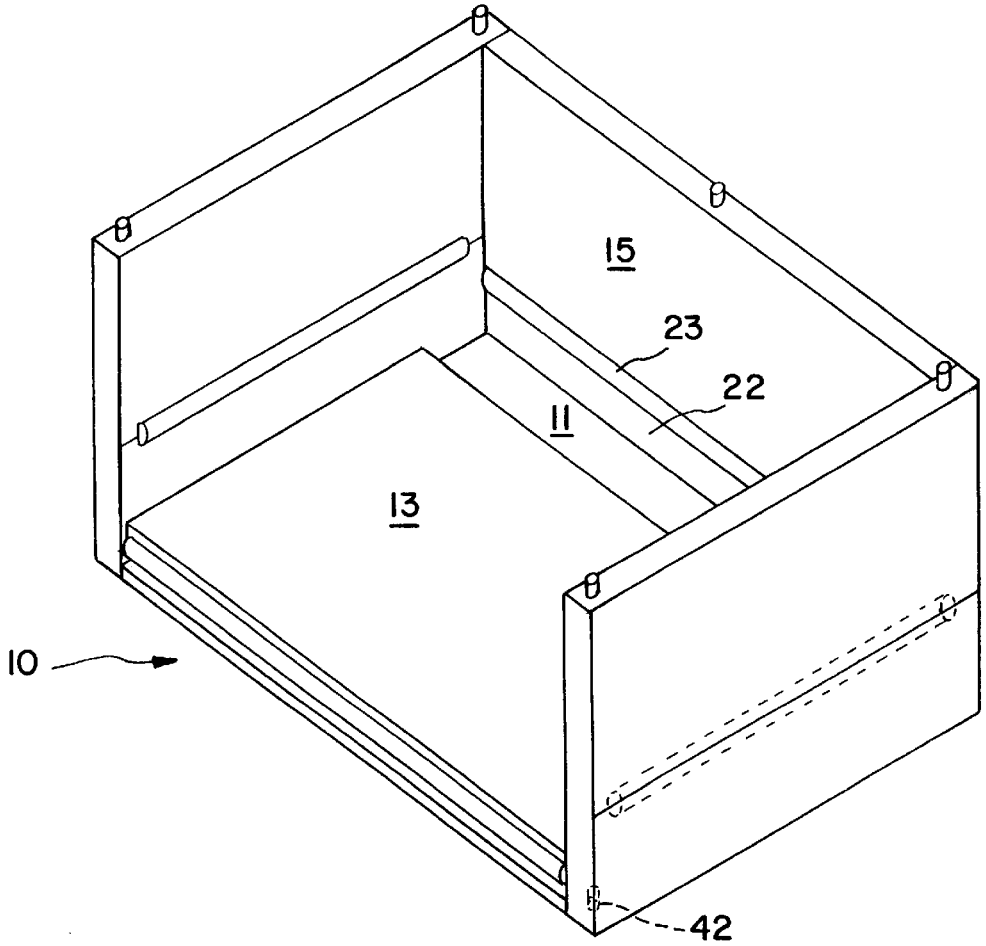
FIG. 5 shows the inventive box with one of its side walls collapsed.

FIG. 5 shows the container 10 with the side wall 13 folded over the bottom wall 11. As should be understood from FIG. 5, the hinge 23 which connects the short wall 22 with the side wall 15 is slightly above the level of the upper surface of the side wall 13 as collapsed so that the side wall 15 may fold thereover in a relatively flat configuration.

Figure 7:
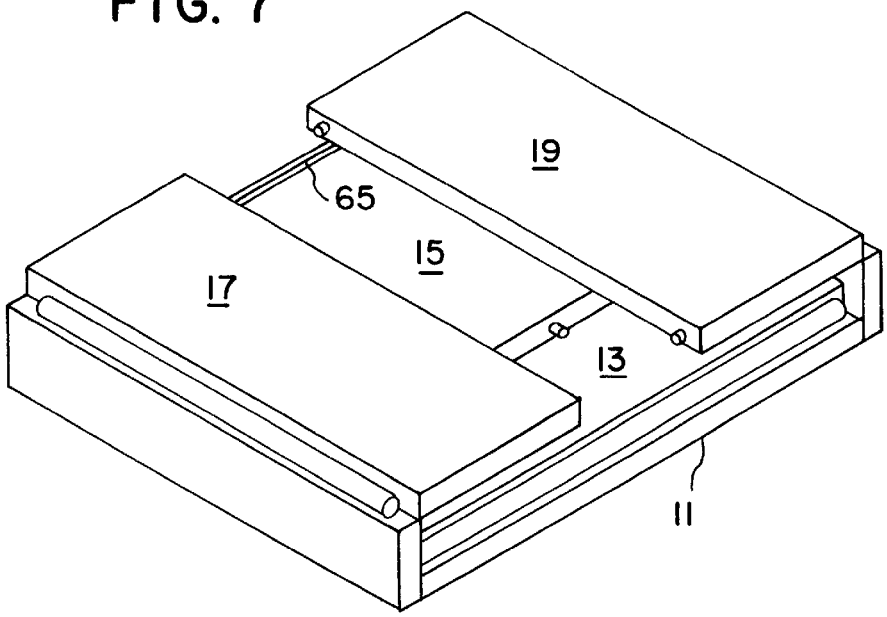
FIG. 7 shows a perspective view of the present invention with all of its walls collapsed.

FIG. 6 shows the second side wall 15 collapsed over the side wall 13 as explained above. FIG. 7 shows the end walls 17 and 19 collapsed over the side wall 15. In this way, the collapsing of the container should be understood.

As explained above, and with particular reference, again, to FIGS. 2 and 3, the hinges which pivotably mount the side and end walls to the bottom wall allow the respective walls to pivot outwardly as well as inwardly. The purpose for permitting outward pivoting is to permit easy cleaning of the inner surfaces of the various walls through the use of a hose or other cleaning equipment.

Figure 10:
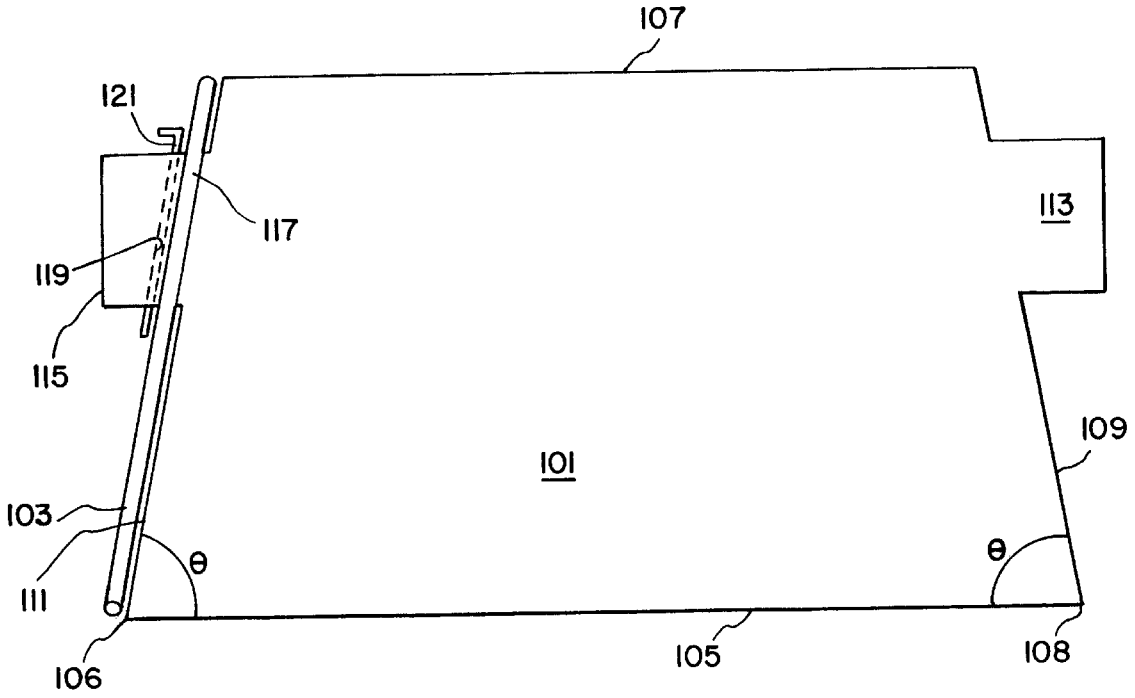
FIG. 10 shows a side view of a further embodiment of the present invention looking directly at one of the side walls thereof.
Figure 11:
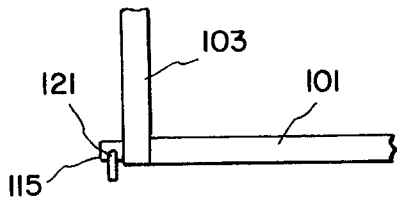
FIG. 11 shows a top view of the view of FIG. 10.
Figure 12:
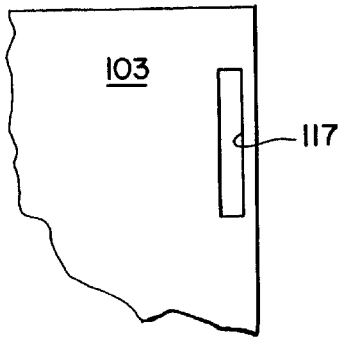
FIG. 12 shows an end view of the embodiment of FIGS. 10 and 11 showing a portion of an end wall thereof.

With reference, now, to FIGS. 10, 11 and 12, a second embodiment of locking means for releasably locking the side and end walls in an erected configuration is shown.

FIG. 10 shows a portion of a container 100, with one side wall 101 and one end wall 103 being particularly shown. As shown, the side wall 101 is of generally trapezoidal configuration having a bottom edge 105, a top edge 107 and side edges 109 and 111. As should be understood from FIG. 10, the bottom edge 105 is slightly longer than the top edge 107 so that the angle θ between the edges 105 and 111, and between the edges 105 and 109 is acute. Thus, in the direction from the edge 105 to the edge 107, the side edges 109 and 111 converge toward one another.

As also shown in FIG. 10, the side edge 109 has a laterally extending protrusion 113 while the edge 111 has a laterally extending protrusion 115 corresponding to the protrusion 113. As should be understood, the laterally outward extent of the protrusions 113 and 115 does not exceed, laterally, the location of the corners 106, 108 of the side wall 101. This configuration is specifically provided so that when the container 100 is collapsed, the protrusions 113, 115 will be located inside the hinges of the end walls so that the side walls may lie flat when the container 100 is collapsed.

With further reference to FIGS. 10 and 12, it is seen that the end wall 103 has an elongated generally rectangular slot 117 extending therethrough and designed to slidably receive the protrusion 115. As shown, in phantom, in FIG. 10, the protrusion 115 has a passageway 119 therethrough sized to slidably receive a locking pin 121 which may be inserted into the passageway 119 as shown in particular in FIG. 10 to lock the side wall 101 and the end wall 103 in an erected configuration. As should be particularly understood from FIG. 10, due to the acute angle θ, and the resulting convergence of the edges 109, 111, the end walls including the end wall 103 must be pivoted toward their collapsed position before engaging the edge 111, in the case of the end wall 103. Thus, when the container 100 is in its erected configuration, the side walls including the side wall 101 are vertical whereas the end walls including the end wall 103 are slightly angled inwardly as particularly shown in FIG. 10.

In the preferred embodiment, the pin 121 may be of L-shaped configuration as shown in FIGS. 10 and 11 so that it will not be easily dislodged from the passageway 119.

With further reference to FIGS. 10–12, as an alternative option to the pin 121, if desired, the side walls of the protrusion 115, which are perpendicular to the end thereof, could be provided with elongated grooves allowing receipt of the legs of a U-shaped clip which would be installed over the protrusion 115 in inverted configuration with the portion of the clip connecting the legs thereof overlying the top wall of the protrusion 115. A further groove could be formed in the said top wall of the protrusion permitting insertion of a cutting instrument to slice through the leg connecting portion of the clip to facilitate removal thereof.

Figure 8:
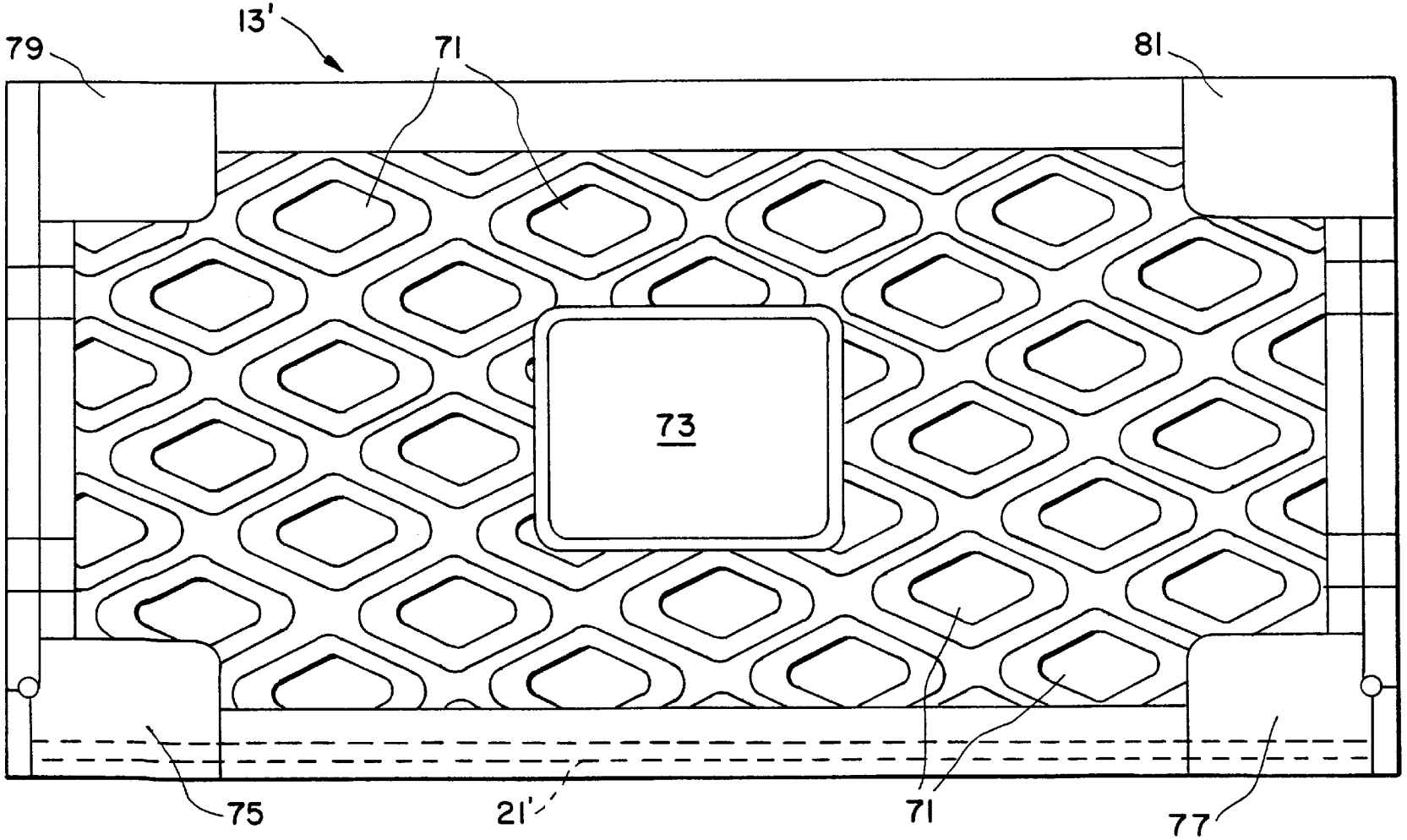
FIG. 8 shows a view of one of the sides of the inventive box showing details of the lattice work and other structure.

FIG. 8 shows a particular preferred embodiment for the specific configuration of the side walls, with FIG. 8 being labelled with the reference numeral 13'. As seen in FIG. 8, the wall structure consists of a lattice-work having a multiplicity of openings 71 therethrough which are shown to be of generally diamond-shaped configuration. The openings 71 are provided to allow efficient ventilation of the contents of the container which typically comprises produce such as fruits and/or vegetables. A flat area 73 is centrally provided in the side wall 13' to permit affixing of a label describing the contents. Additional flat areas 75 and 77 provide places for placement of information such as an additional descriptive label and the country of origin of the goods. An additional flat area 79 is provided for affixing of a bar code label while a further flat area 81 is provided for affixing of an additional label, such as, for example, a label depicting a Trademark for the produce, etc.

Figure 9:
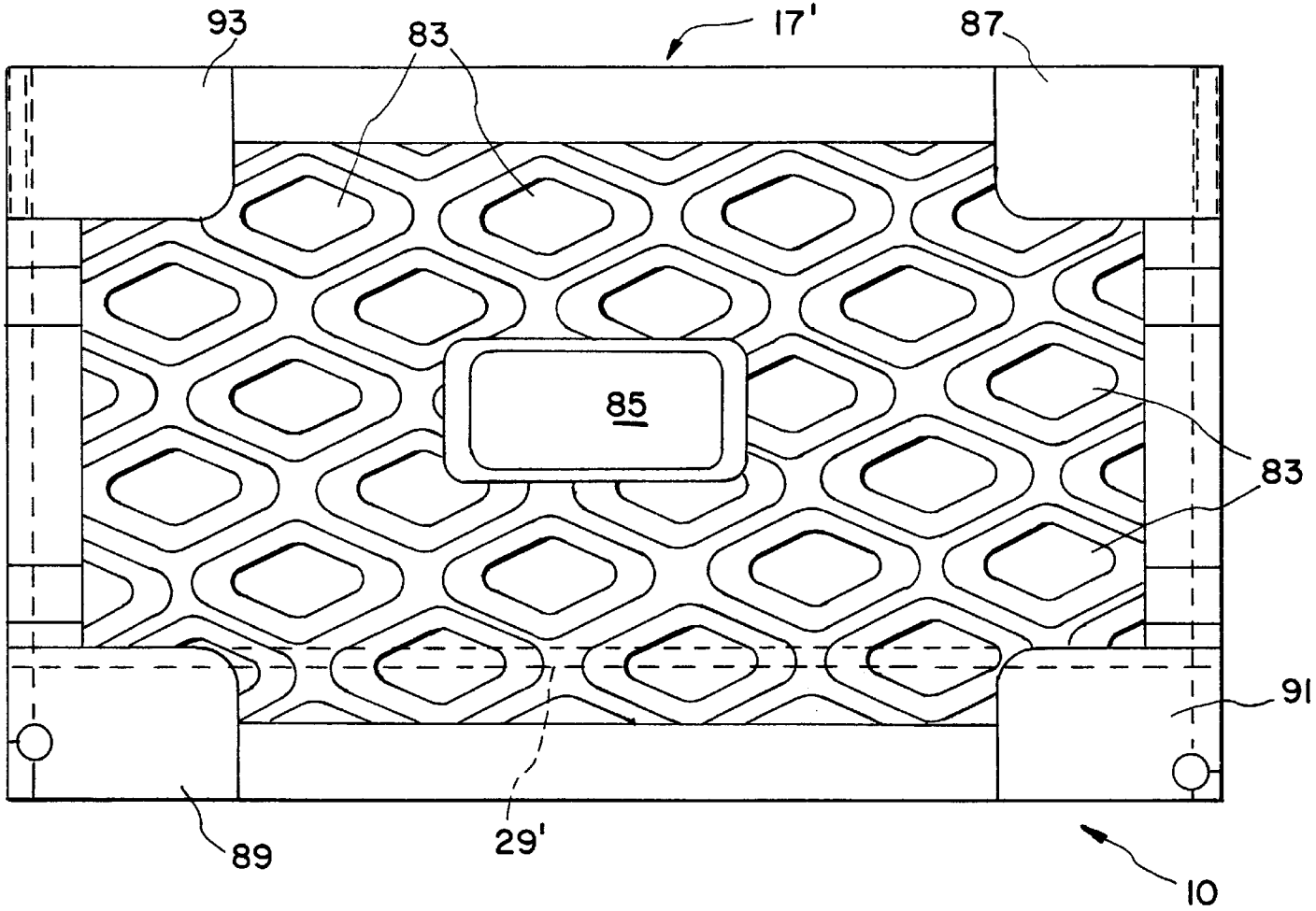
FIG. 9 shows a view of one of the end walls of the present invention showing the lattice work as well as an opening comprising a handle.

FIG. 9 shows a preferred configuration for one of the end walls of the present invention with the structure shown in FIG. 9 being identified by the reference numeral 17'. As shown, the end wall 17' includes a lattice-like configuration including a plurality of openings 83 to provide ventilation as explained above. A central opening 85 permits the user to place a hand therethrough to allow lifting of the container 10. Thus, the opening 85 comprises a handle. Additional flat areas 87, 89, 91 and 93 are provided for affixing of labels or other identifying information including bar code labels, Trademark labels, country of origin labels, etc. While the details of FIGS. 8 and 9 comprise the preferred design, it is also possible to construct the inventive box with solid walls without hand holes.

In the preferred embodiment of the present invention, the various components thereof including the bottom wall or base, side walls and end walls are individually made of plastic in an injection molding process. Of course, these components may be made of a variety of materials, including wood. The various hinges may be integrally formed with the plastic walls or may comprise separate structures fastened thereto in any suitable manner such as with screws. Where the hinges are integrally formed with the various walls, the elongated hinge pin may be made of plastic, wood, metal or any suitable material.

In a further aspect, if desired, during the molding process of the walls, chemicals may be impregnated within the plastic material causing emanation of insect repelling fumes.

In erecting the inventive container 10, the strap 39 may be employed, or alternatively, the projections 55 and recesses 57 may be employed as the sole fastening means. The strap 39 and elements 55, 57 may be used together. These aspects comprise locking means for releasably locking the walls of the container in an erected configuration.

As such, an invention has been disclosed in terms of preferred embodiments thereof which fulfill each and every one of the objects and aspects of the present invention as set forth hereinabove and provides a new and useful improved collapsible box of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

We claim:

1. A collapsible container, comprising:

a) a bottom wall, a pair of side walls and a pair of end walls, said side walls and end walls defining a generally rectangular periphery;

b) a first of said side walls being pivotably connected to said bottom wall by a first hinge mounted adjacent said bottom wall;

c) a second of said side walls being pivotably connected on said container by a second hinge parallel with said first hinge and vertically spaced from said first hinge with respect to said bottom wall;

d) said end walls being pivotably mounted on said container via respective third and fourth parallel hinges, said third and fourth hinges being vertically spaced from said second hinge with respect to said bottom wall;

e) each of said hinges permitting its respective connected wall to pivot from a collapsed inwardly directed generally horizontal configuration to a generally vertical erected configuration and beyond said vertical configuration with respect to said collapsed configuration; and f) locking means for releasably locking said walls in said erected configuration, said locking means including at least one recess in an outer surface of each of said walls, said recesses being vertically aligned with one another, and a strap mounted about said walls and closely retained in said recesses.

2. A collapsible container, comprising:

a) a bottom wall, a pair of side walls and a pair of end walls, said side walls and end walls defining a generally rectangular periphery;

b) a first of said side walls being pivotably connected to said bottom wall by a first hinge mounted adjacent said bottom wall;

c) a second of said side walls being pivotably connected on said container by a second hinge parallel with said first hinge and vertically spaced from said first hinge with respect to said bottom wall;

d) said end walls being pivotably mounted on said container via respective third and fourth parallel hinges, said third and fourth hinges being vertically spaced from said second hinge with respect to said bottom wall;

e) each of said hinges permitting its respective connected wall to pivot from a collapsed inwardly directed generally horizontal configuration to a generally vertical erected configuration and beyond said vertical configuration with respect to said collapsed configuration; and f) locking means for releasably locking said walls in said erected configuration, comprising:

i) said side walls having projections extending laterally outwardly therefrom;

ii) said end walls having openings, each opening being sized to receive a respective projection therethrough; and iii) each projection having an opening therethrough sized to receive a locking pin;

iv) each projection being insertable through a respective opening, whereupon a respective said locking pin may be inserted through a said opening in a said projection to lock said walls together.

3. The container of claim 2, wherein each said projection laterally protrudes from a side edge of a said side wall, each said side edge forming an acute angle with a respective bottom edge of a said side wall.

4. A collapsible container, comprising:

a) a bottom wall, a pair of side walls and a pair of end walls, said side walls and end walls defining a generally rectangular periphery;

b) a first of said side walls being pivotably connected to said bottom wall by a first hinge mounted adjacent said bottom wall;

c) a second of said side walls being pivotably connected on said container by a second hinge parallel with said first hinge and vertically spaced from said first hinge with respect to said bottom wall;

d) said end walls being pivotably mounted on said container via respective third and fourth parallel hinges, said third and fourth hinges being vertically spaced from said second hinge with respect to said bottom wall;

e) each of said hinges permitting its respective connected wall to pivot from a collapsed inwardly directed generally horizontal configuration to a generally vertical erected configuration and beyond said vertical configuration with respect to said collapsed configuration; and f) locking means for releasably locking said walls in said erected configuration, said locking means comprising:

i) said side walls having outwardly facing side edges having side surfaces with elongated grooves therein;

ii) each of said end walls having an inner surface with respective elongated projections complementary with said grooves;

iii) said projections being insertable into said grooves when said walls are erected to lock said walls in said erected configuration.

5. The container of claim 4, wherein said second of said side walls has an outer surface with a further elongated groove therein corresponding in configuration to said elongated grooves, one elongated projection from each of said end walls being insertable into said further elongated groove to lock said container in a container collapsed configuration.

6. The container of claim 4, wherein said locking means further includes at least one recess in an outer surface of each of said walls, said recesses being vertically aligned with one another, and a strap mounted about said walls and retained in said recesses.

7. A collapsible container, comprising:

a) a bottom wall, a pair of side walls and a pair of end walls, said side walls and end walls defining a generally rectangular periphery;

b) a first of said side walls being pivotably connected to said bottom wall by a first hinge mounted adjacent said bottom wall;

c) a second of said side walls being pivotably connected on said container by a second hinge parallel with said first hinge and vertically spaced from said first hinge with respect to said bottom wall;

d) said end walls being pivotably mounted on said container via respective third and fourth parallel hinges, said third and fourth hinges being vertically spaced from said second hinge with respect to said bottom wall;

e) each of said hinges permitting its respective connected wall to pivot from a collapsed inwardly directed generally horizontal configuration to a generally vertical erected configuration and beyond said vertical configuration with respect to said collapsed configuration; and f) locking means for releasably locking said walls in said erected configuration, said locking means including at least one recess in an outer surface of one of said walls, and a strap mounted about said walls and closely retained in siad recess.

8. A collapsible container, comprising:

a) a bottom wall, a pair of side walls and a pair of end walls, said side walls and end walls defining a generally rectangular periphery;

b) a first of said side walls being pivotably connected to said bottom wall by a first hinge mounted adjacent said bottom c) a second of said side walls being pivotably connected on said container by a second hinge parallel with said first hinge and vertically spaced from said first hinge with respect to said bottom wall;

d) said end walls being pivotably mounted on said container via respective third and fourth parallel hinges, said third and fourth hinges being vertically spaced from said second hinge with respect to said bottom wall;

e) each of said hinges permitting its respective connected wall to pivot from a collapsed inwardly directed generally horizontal configuration to a generally vertical erected configuration and beyond said vertical configuration with respect to said collapsed configuration; and f) locking means for releasably locking said walls in said erected configuration, said locking means comprising:

i) said side walls having outwardly facing side edges having side surfaces, and each of said end walls having an inner surface;

ii) one of said side edges having an elongated groove therein, and one of said end surfaces having an elongated projection extending therefrom and complementary with said groove;

iii) said projection being insertable into said groove when said walls are erected to lock said walls in said erected configuration.

9. A collapsible container, comprising:

a) a bottom wall, a pair of side walls and a pair of end walls, said walls and end walls defining a generally rectangular periphery;

b) a first of said side walls being pivotably connected to said bottom wall by a first hinge mounted adjacent said bottom wall;

c) a second of said side walls being pivotably connected on said container by a second hinge parallel with said first hinge and vertically spaced from said first hinge with respect to said bottom wall;

d) said end walls being pivotably mounted on said container via respective third and fourth parallel hinges, said third and fourth hinges being vertically spaced from said second hinge with respect to said bottom wall;

e) each of said hinges permitting its respective connected wall to pivot from a collapsed inwardly directed generally horizontal configuration to a generally vertical erected configuration and beyond said vertical configuration with respect to said collapsed configuration; and f) locking means for releasably locking said walls in said erected configuration, said locking means including at least one recess in an outer surface of opposed ones of said walls, said recesses being vertically aligned with one another, and a strap mounted about said walls and closely retained in said recesses.

10. The collapsible container of claim 9, wherein said opposed ones of said walls comprise said side walls.

11. The collapsible container of claim 9, wherein said opposed ones of said walls comprise said end walls.

* * * * *